US005819937A

United States Patent [19]

Walker

[11] Patent Number: 5,819,937

[45] Date of Patent: Oct. 13, 1998

[54] BOTTLE ORGANIZER

[76] Inventor: Kimberly K. Walker, 429 E. First St., Tustin, Calif. 92780

[21] Appl. No.: 857,997

[22] Filed: May 16, 1997

[51] Int. Cl.[6] ..... B65D 1/36; F25D 25/00; A47B 73/00

[52] U.S. Cl. ..... 206/429; 62/378; 206/203; 206/557; 211/74; 312/36

[58] Field of Search ..... 206/203, 427, 206/429, 557, 561, 564; 312/402, 408, 36; 221/66, 67, 281; D3/304, 310, 313, 314; 211/74; 62/378, 382

[56] References Cited

U.S. PATENT DOCUMENTS

| | | | |
|---|---|---|---|
| 1,872,031 | 8/1932 | Frick et al. | 312/36 |
| 2,029,109 | 1/1936 | Kucher | 312/36 |
| 2,029,763 | 1/1936 | Reighley | 62/378 |
| 2,132,632 | 10/1938 | Kondolf | 206/427 |
| 2,375,643 | 5/1945 | Germanotta | 206/564 X |
| 2,550,154 | 4/1951 | Kolacy | 206/561 |
| 2,678,735 | 5/1954 | Creedon | 211/74 |
| 3,605,435 | 9/1971 | Taylor | 206/427 X |
| 4,928,841 | 5/1990 | Arthurs | 206/203 X |

FOREIGN PATENT DOCUMENTS

| | | | |
|---|---|---|---|
| 0648193 | 3/1985 | Switzerland | 211/74 |

*Primary Examiner*—Bryon P. Gehman
*Attorney, Agent, or Firm*—Roger A. Marrs

[57] ABSTRACT

A bottle organizer includes a tray having a U-shaped open-ended channel for insertably receiving a plurality of food product containers such as bottles with baby formula. The tray has a bottom with a pair of upstanding U-shaped walls that have opposing spaced-apart surfaces defining the channel. Indicia is disposed at the open ends of the channel denoting an entrance and an exit respectively. Fastener elements such as suction cups may be employed to hold the tray onto a storage shelf and the length of the channel is substantially equal to the length of the plurality of bottles or containers held within the channel between its opposite ends. An ancillary storage compartment is defined in the central area between opposing surfaces of the inner wall.

2 Claims, 1 Drawing Sheet

BOTTLE ORGANIZER

BACKGROUND OF THE INVENTION

1. Field of the Invention

The present invention relates to the field of infant accessory organizers, and more particularly to a novel tray or carrier for a plurality of baby bottles which may be conveniently stored in a refrigerator so that the contents of each bottle remain fresh and available for first use.

2. Brief Description of the Prior Art

In the past, it has been the conventional practice to place baby food such as formula within a container such as a bottle or bottle-like construction that may be subsequently used for directly introducing the contents to the infant or baby. When the fruit product, particularly formula, is initially prepared, sufficient amount is produced to fill a plurality of bottles for use over a period of time. For example, it is customary to prepare sufficient formula so as to fill eight baby bottles which generally covers a 24 hour time period. When the plurality of bottles have been filled, they are stored in a refrigerator and sometimes inadvertently mixed with other baby bottles so that the time period cannot be accurately controlled or be maintained. The result may include dispensing of food product which is stale or old and therefore, becomes harmful or of little nutritional value.

Some attempts have been made to place labels or tags onto individual bottles which denote the time of preparation or the time period after preparation that the food product should be used. In some instances, the information is contained on a tag or adhesive label; however, no attempt is made to place the bottles in a particular relationship within the refrigeration unit so that the user must observe all of the bottles in order to make a selection at feeding time.

Therefore, a long-standing need has existed to provide a novel means for holding a plurality of containers having infant or baby product contained therein wherein each of the containers may be related with the other containers with respect to preparation time and using time. Also, an orderly storage means must be employed to permit additional containers to be added to the plurality and to permit selected containers to be removed.

SUMMARY OF THE INVENTION

Accordingly, the above problems and difficulties are avoided by the present invention which provides a novel bottle or container organizer which comprises a tray-like means having a U-shaped track defined between inner and outer partitions for receiving and movably storing a plurality of bottles or containers. The U-shaped channel or track is open-ended so that bottles may be introduced through one end of the channel and removed from the other end of the channel. Friction means, such as ridges or dimples, may be placed on the track, particularly at the entrance and the exit thereto, for yieldably restricting the movement of the bottles within the channel. A feature resides in providing a storage area between the two parallel legs of the U-shaped channel that can be employed for storing additional containers associated with infant care. Also, handles may be provided on the opposite sides of the tray-like means so that the plurality of containers may be removed, carried or transported as a unit from place to place. Also, a plurality of holes may be provided for accommodating fastener means intended to releasably adhere to structure within the refrigerator. Such fastener means may take the form of suction cups, adhesive or hook and pile fastening means.

Therefore, it is among the primary objects of the present invention to provide a novel tray or holder for a plurality of infant or baby bottles which may be readily advanced along a U-shaped track or channel by pushing the bottles through one end of the channel and permitting removal of a selected bottle from the end of the channel.

Another object of the present invention is to provide a novel tray for holding a plurality of infant or baby bottles containing formula and which provides a means for dispensing or removal of a bottle within a time period so that the contents are fresh and nutritious.

Another object of the present invention is to provide a bottle organizer having an inlet into a storage channel and an outlet for removal of a bottle and wherein the bottles may be advanced by pushing one bottle against the other to move the plurality along the channel.

A further object resides in providing a bottle organizer having a storage channel with frictional means for restricting removal of the bottles at an outlet and for retaining the bottles within the channel at the inlet.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
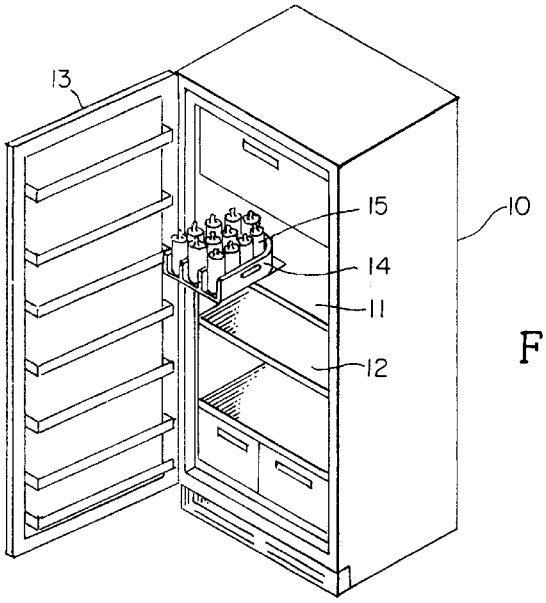
FIG. 1 is a reduced perspective view showing the bottle organizer of the present invention preparatory for insertion into a refrigerated environment.

Referring to FIG. 1, a kitchen appliance, such as a refrigerator, is indicated by numeral 10 which includes a plurality of standard shelves, such as indicated by numerals 11 and 12. The door of the refrigerator is indicated by numeral 13 and is illustrated in its open position so as to expose the refrigerated interior storage compartment of the refrigerator 10.

The inventive concept includes a tray 14 for holding a plurality of food product such as bottles 15 which may contain baby formula or the like that is required to be refrigerated. It can be seen that the arrangement of the plurality of bottles 15 is such that they are upstanding and reside adjacent to one another so that the outer arrangement forms a U-shape in top plan view and that other selected food product containers are arranged in an in-line row central to the U-shaped arrangement.

Figure 2:
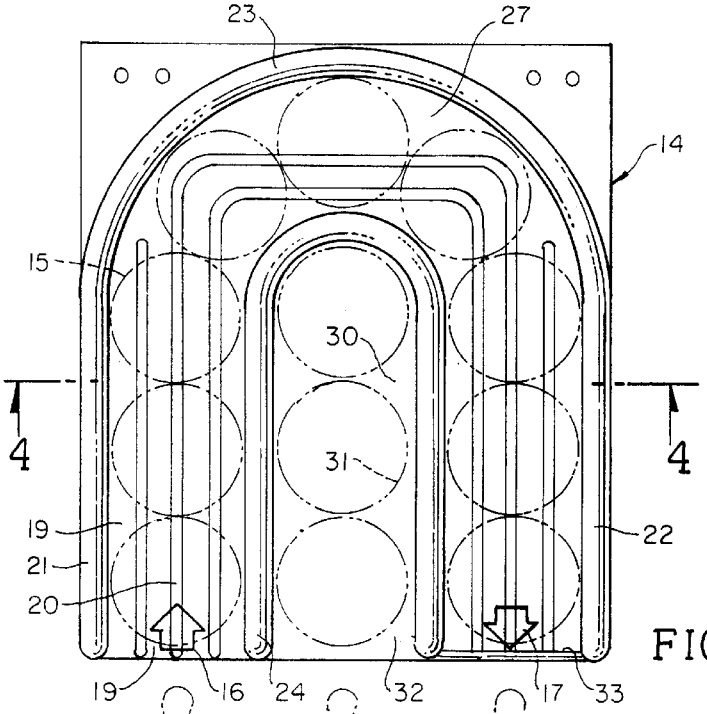
FIG. 2 is an enlarged top plan view of the bottle organizer shown in FIG. 1.

Referring now in detail to FIG. 2, the novel tray 14 includes a U-shaped track broadly indicated by numeral 19 having an inlet denoted by an arrow 16 leading through the open end of the track of channel 19 and terminating at its opposite end in an arrow 17 representing the output through the open end of the track or channel 19. The plurality of bottles, such as the bottle 15, rests on top of a plurality of ridges, such as ridge 20, which runs the full length and curve of the U-shaped track or channel 19.

The sides of the open-ended track 19 are defined by a continuous wall 21 which merges with wall 22 by means of a curved section wall 23. The inner wall defining the inside of the U-shaped track or channel 19 is indicated by numeral 24 and follows the curve and course of the wall 21–23. Not only are the opposite ends of the track or channel open but the top of the track is exposed so as to permit the food product containers 15 to ride on the ridges in an upright vertical position. The outside liner wall sections 21 and 22 are provided with handles represented by cutouts 25 and 26 and a plurality of holes are in the outer sidewall for holding or attaching fasteners such as suction cups or the like. Holes can also be placed on a bottom, represented by numeral 27, for attaching suction cups so that the tray 14 can be held on a shelf, such as shelf 11 of the refrigerator 10.

Figure 3:
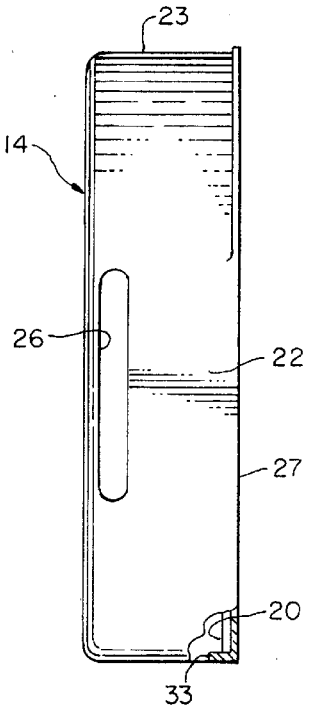
FIG. 3 is a side elevational view of the bottle organizer.
Figure 4:
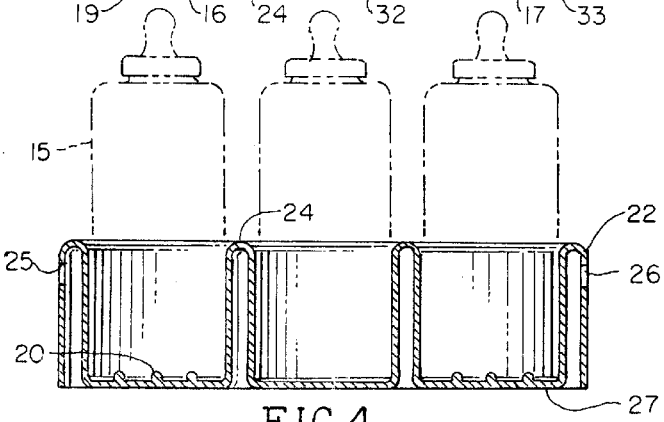
FIG. 4 is a transverse cross-sectional view of the bottle organizer shown in FIG. 2 as taken in the direction of arrows 4—4 thereof.

Referring now in detail to FIGS. 2–4 inclusive, it can be seen that the channel, track or path 19 is open-ended and that the arrow 16 includes indicia visually observable by the user to indicate that the food containers, such as bottles 15, are to be inserted at one end of the channel and are to be extracted at the opposite end, as indicated by the arrow 17 with attendant indicia. Disposed between the opposite wall surfaces of wall 24, a storage compartment 30 is provided into which several food containers may be placed. This central storage area 30 contains bottles such as indicated by numeral 31 and the compartment is open-ended at end 32 to permit the food container to be introduced into the storage compartment 30 or withdrawn therefrom. Therefore, it is noted that the channel or track 19 is curved and that the compartment 30 is linear.

In view of the foregoing, it can be seen that the novel tray of the present invention holds a plurality of food product containers, such as bottled baby formula, and that a specific number of containers is held within the channel 19 and/or the compartment 30. The specific number of bottles is equal to the storage or shelf life of the food product contained within the container so that assurance is given to the user that as the bottles or containers are withdrawn from the end of channel 19 via outlet 17, the contents will be fresh and usable. Food product bottles may be introduced through the entrance 16 and may progress along the curvilinear track 19 until the bottle reaches the outlet 17. The user urges the bottles through the track by manual force since the containers will bear against one another as the user pushes a new bottle through the entrance 16. The linear storage compartment 30 may be used for other food containers, such as baby food or the like. Preferably, the curvilinear track 19 is intended to carry eight or nine food product containers as this is the shelf life of baby formula preferred to be used. Ridge 33 prevents bottles from being pushed out of channel exit.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A bottle organizer comprising:

a tray having a bottom and a pair of sidewalls constituting an inner wall in spaced-apart relationship with respect to an outer wall;

said tray having a curvilinear channel defined between opposing surfaces of said inner and said outer walls;

said curvilinear channel being open at opposite ends and adapted to insertably receive a bottle through one end and have the bottle exit said channel through the other end;

said outer wall having hand-carrying means;

said channel is of U-shaped configuration;

indicia carried on said bottom at said channel opposite ends indicating insertion and exit ends thereof;

at least two raised ridges extending from said bottom within said channel, adapted to support bottles thereon; and a central storage compartment defined between opposing wall surfaces of said inner wall for accommodating at least three bottles.

2. The organizer as defined in claim 1 wherein:

said inner wall and said outer wall terminate in rounded configuration to define a U-shaped open top to said channel.

* * * * *